United States Patent [19]

Tiso

[11] 4,163,552

[45] Aug. 7, 1979

[54] APPARATUS FOR FACILITATING THE PRACTICING OF TENNIS AND LIKE GAMES

[76] Inventor: Marian Tiso, Kurt-Eisner-Strasse 25, D-8000 Münich 83, Fed. Rep. of Germany

[21] Appl. No.: 887,312

[22] Filed: Mar. 16, 1978

[30] Foreign Application Priority Data

Mar. 24, 1977 [DE] Fed. Rep. of Germany ..... 2713089

[51] Int. Cl.[2] ..... A63B 69/38

[52] U.S. Cl. ..... 273/29 A; 35/29 R; 273/191 B; 273/193 A

[58] Field of Search ..... 273/29 A, 73 R, 26 B, 273/186 R, 186 A, 183 D, 183 A, 191 R, 191 B, 194 R, 193 A; 35/29 R, 29 A

[56] References Cited

U.S. PATENT DOCUMENTS

| | | | |
|---|---|---|---|
| 1,712,609 | 5/1929 | Gibson | 273/194 R |
| 2,630,012 | 3/1953 | Walker | 273/194 R |
| 2,723,125 | 11/1955 | Comee | 273/194 R |
| 2,780,098 | 2/1957 | Maroth | 273/29 A |
| 3,037,777 | 6/1962 | Chedister et al. | 273/194 R |
| 3,083,016 | 3/1963 | Sumegi | 273/193 R |
| 3,180,308 | 4/1965 | Carroll | 273/194 R |
| 3,424,462 | 1/1969 | Driscoll | 273/194 R |
| 3,848,873 | 11/1974 | Linning | 273/194 R |
| 4,034,991 | 7/1977 | Oppenheimer | 273/191 B |

FOREIGN PATENT DOCUMENTS

| | | | |
|---|---|---|---|
| 133879 | 10/1919 | United Kingdom | 273/73 R |

*Primary Examiner*—Richard C. Pinkham
*Assistant Examiner*—T. Brown
*Attorney, Agent, or Firm*—Peter K. Kontler

[57] ABSTRACT

Apparatus which indicates various stages of forehand or backhand strokes which are practiced by a tennis player with or without a ball, with or without an opponent and without supervision has a disk-shaped support which is mounted on the innermost part of the handle of a tennis racket, a circumferentially complete rail at the periphery of the support, a carriage which is freely slidable along the rail, and a set of adjustable bells mounted on the support radially inwardly of the rail to be struck by an elastic prong on the carriage in selected angular positions of the carriage, namely, in those positions which designate important parts of the stroke practiced by a tennis player. The carriage can be tied to an elastic band so that the support and its rail normally move relative to the carriage, or the carriage is free to slide along the rail by inertia and/or under the action of gravity.

20 Claims, 8 Drawing Figures

FIG. 1
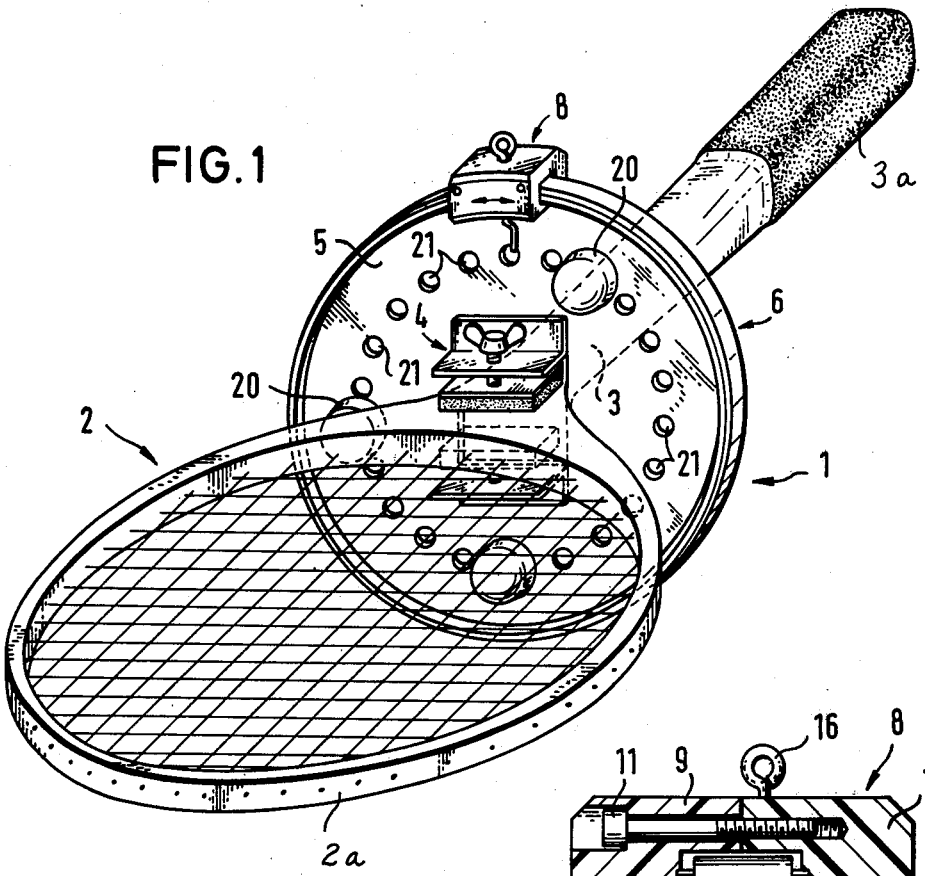
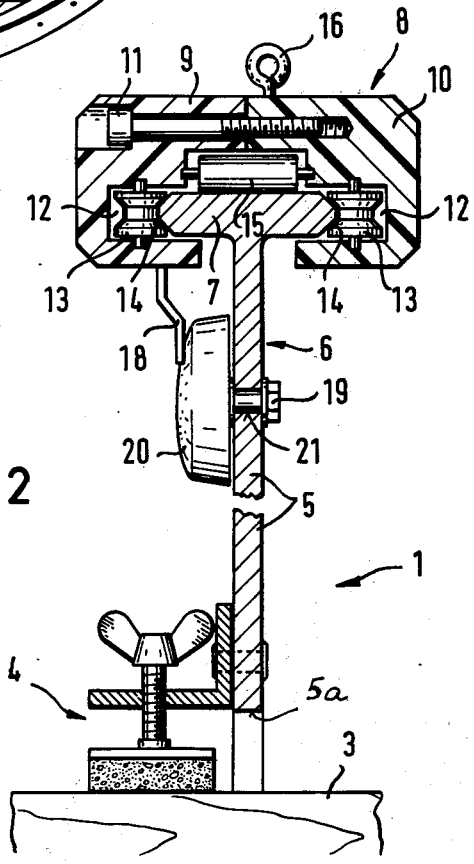
FIG. 2
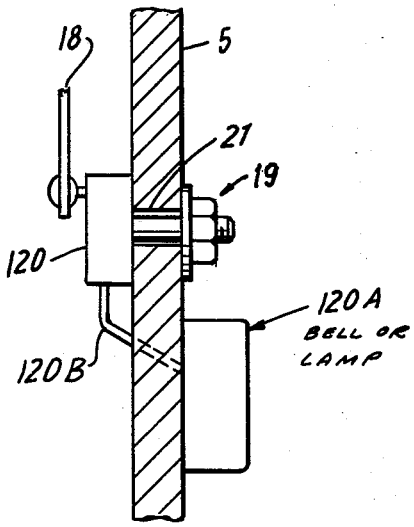
FIG. 8

FIG. 4
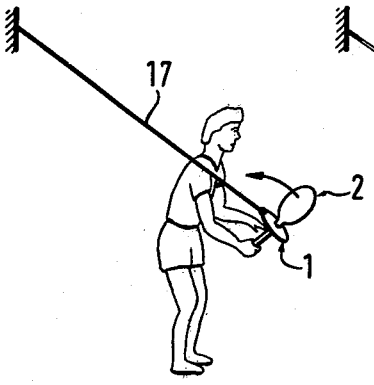
FIG. 5
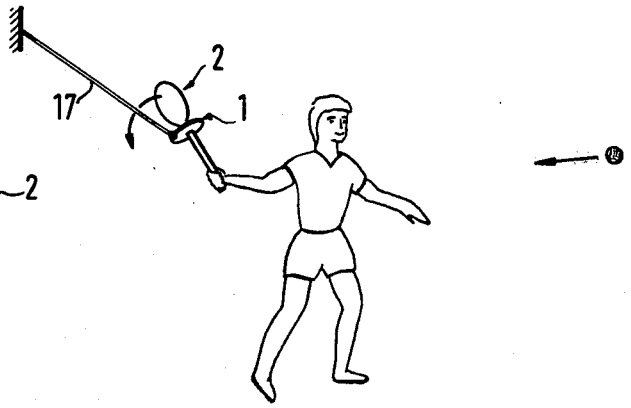
FIG. 3
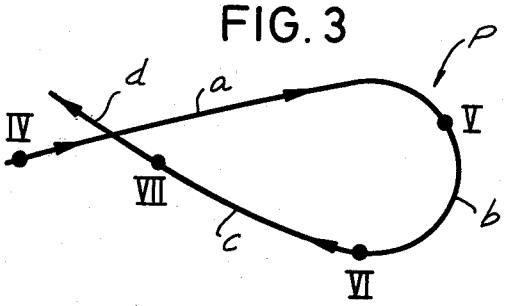
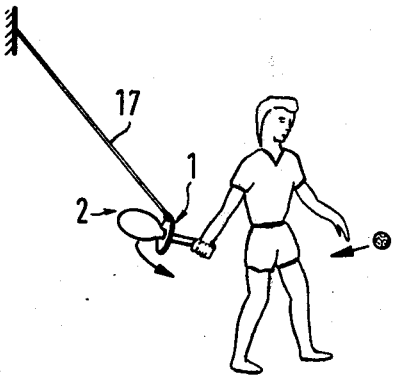
FIG. 6
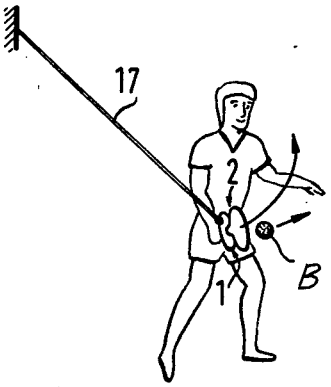
FIG. 7

APPARATUS FOR FACILITATING THE PRACTICING OF TENNIS AND LIKE GAMES

BACKGROUND OF THE INVENTION

The present invention relates to apparatus for facilitating the practicing of tennis or similar games which involve the use of rackets, bats or analogous ball-striking implements. More particularly, the invention relates to apparatus which enable a player, for example, a tennis player, to practice the game without any supervision by instructors. Still more particularly, the invention relates to apparatus which can be applied directly to the ball-striking implement to indicate the quality of strokes or swings regardless of whether the game is practiced with or without a ball and with or without an opponent. The following description will deal with the application of the apparatus to rackets which are used by tennis players; however, it will be understood that the apparatus can be used with equal advantage for the practicing of other games, such as badminton, racquets, table tennis, baseball, golf and/or others.

As a rule, a tennis player who desires to improve his or her game will engage an instructor, such as a pro, who observes the player and informs him, orally, whether or not the player has properly executed a forehand or a backhand stroke. An advantage of such type of practice is that the player receives undivided individual attention during the interval which is available for a session under the supervision of a skilled instructor. On the other hand, the just described mode of practicing is rather expensive and the appointments cannot be scheduled at will, i.e., the player must seek an appointment with the instructor and may not be able to practice whenever he or she is free to devote some time to his or her favored game, for example, at the player's home or in the backyard.

OBJECTS AND SUMMARY OF THE INVENTION

An object of the invention is to provide a novel and improved apparatus which enables a player, either a novice, a skilled amateur or a professional, to practice with a ball-striking implement without any supervision by an instructor.

Another object of the invention is to provide an apparatus which can be utilized to facilitate the practicing of different types of strokes, such as forehand and backhand strokes in the game of tennis, whenever and wherever the player finds time for the practice.

A further object of the invention is to provide an apparatus which can be used with equal advantage on a court or indoors so that the person desiring to practice the game need not spend any time for travel but can proceed whenever and wherever he or she finds some time for such activity.

An additional object of the invention is to provide an apparatus which can be used with equal advantage by adults or juveniles, whose manipulation is not tiresome to the user, which can be readily adjusted to suit the individual needs of the user, and which can be installed on or combined with existing ball-striking implements.

A further object of the invention is to provide an apparatus which is simple and compact, which can be carried along in the case for a tennis racket or a similar implement, and which can be attached to or detached from an implement with little loss in time.

Another object of the invention is to provide the apparatus with novel and improved means for indicating various stages of movement of a ball-striking implement so that the person using the apparatus can concentrate on those strokes which are the weaker points of his or her game, e.g., on forehand or backhand strokes when the game is tennis.

The invention is embodied in an apparatus for facilitating the practicing of tennis or like games, and more particularly in an apparatus for indicating various stages of strokes which are practiced by the user of a ball-striking implement (especially a tennis racket) having a handle and a ball-contacting portion. The apparatus comprises a support (e.g., a flat disk having a diameter of between 5 and 40 centimeters) which is connected to the handle (preferably to the innermost portion of the handle close to the ball-contacting portion of the implement), annular guide means provided on the support and spacedly surrounding the handle (such guide means may include a circumferentially complete ring-shaped rail or rim at the periphery of the disk), and signal generating means including a carriage or slide which is movably mounted on the guide means so that it can travel, with negligible friction, in a clockwise or counterclockwise direction and means for producing visible and/or audible signals in preselected positions of the carriage with respect to the guide means or vice versa. The signal producing means preferably includes a first component (e.g., an elastic metallic prong) on the carriage and a plurality of second components (e.g., mechanically actuatable bells or electric switches) mounted on the support radially inwardly of the guide means in the path of movement of the first component with the carriage to produce signals when engaged by the first component. The second components are preferably adjustable relative to the support so that they can be mounted in preselected positions corresponding to certain portions of a forehand or backhand stroke which is practiced by a player. The aforementioned disk-shaped support is preferably installed in a plane which is normal or substantially normal to the longitudinal direction of the handle and is preferably provided with a central opening which is large enough to permit insertion or withdrawal of the handle. The apparatus then further comprises suitable fastening means which releasably secures the support to a selected portion of the handle.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawings.

BRIEF DESCRIPTION OF THE DRAWING

FIG. 1 is a perspective view of a tennis racket and of an apparatus which embodies one form of the invention, the support of the apparatus being attached to the foremost portion of the handle of the tennis racket;

FIG. 2 is an enlarged fragmentary axial sectional view of the apparatus of FIG. 1;

FIG. 3 shows a curve which denotes the path of the tennis racket while a player practices forehand strokes;

FIG. 4 illustrates a player and the racket, with the apparatus mounted thereon and attached to an elastic band, while the racket is held in a position preceding the movement along the path shown in FIG. 3;

FIG. 5 illustrates the player and the racket in a different position with the racket on its way toward contact with a ball;

FIG. 6 shows the player and the racket with the racket in a further intermediate position prior to contact with the ball;

FIG. 7 shows the player and the racket with the racket in a position immediately before, during or immediately following contact with the ball; and FIG. 8 is a fragmentary sectional view of a modified apparatus.

DESCRIPTION OF THE PREFERRED EMBODIMENTS

The apparatus 1 of FIG. 1 is separably fastened to the foremost or neck portion 3 of the elongated handle 3*a* of a tennis racket 2. The ball-contacting or engaging portion of the racket is shown at 2*a*. The fastening means for separably securing the apparatus 1 to the handle 3*a* includes one or more wing nuts 4 and/or other suitable fasteners. The apparatus 1 comprises a substantially flat disk-shaped support 5 which has a central opening 5*a* (see FIG. 2) large enough to permit the handle 3*a* to pass therethrough. Once the support 5 is moved to the position of FIG. 1, the fastening means 4 is applied to hold the support in a plane which is normal or nearly normal to the axis (longitudinal direction) of the handle 3*a*. The diameter of the support 5 may vary within a wide range, e.g., between 5 and 40 centimeters, and is preferably about 15 centimeters.

The marginal portion of the support 5 constitutes or is connected with an annular guide 6 which includes a circumferentially complete ring-shaped rail or rim 7 best shown in FIG. 2. The guide 6 serves to support and to control the movements of a carriage or slide 8 constituting one element of signal generating means which enables the player to monitor his or her swings indoors or outdoors (e.g., in the yard of a private home, on a tennis court or at any other place where the player finds enough room to swing the racket in a manner that is necessary during a game of tennis).

FIG. 2 shows that the carriage 8 comprises two mirror symmetrical sections 9 and 10 which are connected to each other by one or more screws 11 or analogous removable connecting means. The sections 9 and 10 have discrete recesses or sockets 12 for profiled roller followers 14 which track the adjacent mutually inclined surfaces 14 of corresponding roof-shaped portions of the rim 7. There are two surfaces 14 for each of the roller followers 13. It is clear that each of the sections 9, 10 may carry a row of two or more roller followers 13 and that the dimensions of the right-hand roller follower 13 (as viewed in FIG. 2) and of the corresponding surfaces 14 need not be identical with those of the left-hand follower and associated surfaces. All that counts is to insure that the carriage 8 can freely slide along the rim 7 with a minimum of friction. To this end, the shafts of the roller followers 13 may be mounted in antifriction bearings and the surfaces of the roller followers and/or the surfaces 14 may be coated with films of friction-reducing material. It is desirable to guide the carriage 8 along three or more different tracks.

In order to further reduce friction between the carriage 8 and the rail or rim 7, as well as to prevent tilting and jamming of the carriage, the latter is preferably provided with one or more additional roller followers (e.g., in the form of cylindrical rolls 15 one of which is shown in FIG. 5) which are in contact with and roll along the periphery of the rim 7.

The radially outermost portion of the carriage 8 is provided with an eyelet 16 or analogous anchoring means for one end of an elastic flexible element 17 (see FIGS. 4 to 7) which may constitute a rubber band.

The carriage 8 is further provided with a radially inwardly extending elastic prong or trip 18 which is adjacent to one side of the support 5 and can strike suitably distributed bells 20 in selected angular positions of the carriage 8 with respect to the support 5 or vice versa. The bells 20 are adjustable, as considered in the circumferential direction of the support 5. To this end, the support 5 is formed with an annulus of discrete holes 21 for the shanks of screws or bolts 19 which serve to detachably couple the bells 20 to the support 5 in selected positions. More accurate adjustments of the bells 20 can be achieved by replacing the holes 21 with arcuate slots and by designing the screws 19 or analogous coupling means in such a way that each such coupling means can hold a bell in any desired position between the two ends of the respective slot. The prong 18 is sufficiently elastic to be capable of moving beyond a bell 20 without unduly interfering with further travel of the carriage 8 along the rim 7 and/or vice versa.

FIGS. 4 to 7 illustrate one mode of utilizing the apparatus 1 for the practice of a tennis player's forehand or backhand strokes. It is assumed that the player is a novice, e.g., a juvenile who must practice forehand as well as backhand strokes. When performing an acceptacle forehand stroke, the player will move the racket along a loop-shaped path P which is shown in FIG. 3. The character IV denotes the locus of the initial position of the racket 2 (see also FIG. 4), the character V denotes a first intermediate position of the racket (see also FIG. 5), the character VI denotes a further intermediate position of the racket (see also FIG. 6), and the character VII denotes the position of the racket immediately before, during or immediately after contact of the portion 2*a* with a ball B (see also FIG. 7).

The eyelet 16 is connected to one end portion of the elastic band 17 the other end portion of which is attached to a pole, to a wall or to any other anchoring means, e.g., at a level approximately 2.3 meters above the ground. A skilled player who merely wishes to perfect his or her strokes can operate without the band 17.

Each forehand stroke can be said to consist of three parts or stages, namely, the downswing part, the ball-contact part and the follow-through part. The downswing in the course of a forehand stroke involves the movement from the initial portion (character IV) to the portion VII of the path P shown in FIG. 3; the ball-contacting part is that in the region of the character VII, and the follow-through part immediately follows the ball-contacting part. The situation is analogous when the player practices backhand strokes; the path along which the racket travels during such practice is a mirror image of the path P shown in FIG. 3 and the first or foremost part can be called an upswing.

As shown in FIG. 4, the racket 2 is held in the initial or starting position (reference character IV in FIG. 3). The carriage 8 contacts the uppermost portion of the rim 7 because its eyelet 16 is connected with the band 17 which is under tension. The other end of the band 17 is secured to a post or the like behind the player so that the band passes at a level above one of the shoulders when the racket 2 is held in the position of FIG. 4. When the player proceeds with the initial part of the forehand stroke, and if the initial part of the stroke is satisfactory, the racket 2 will move along the section a of the path P, i.e., from the portion IV toward the portion V. The carriage 8 continues to remain at the uppermost point of the rim 7 because the band 17 is under tension. However, the support 5 and its rim 7 rotate with the handle 3*a*, i.e., the rim 7 moves relative to the carriage 8 and the prong 18 strikes the oncoming bell 20 when the racket 2 reaches the position of FIG. 5 (provided, of course, that the initial part of the forehand stroke is satisfactory).

In order to properly advance the racket 2 along the section b of the path P, the player must move the racket around the band 17 (in a clockwise direction, as viewed in FIG. 3) whereby the racket moves toward the position which is shown in FIG. 6 (see the character VI in FIG. 3). Such movement around the band 17 renders it necessary to guide the racket along or very close to the arcuate path section b, i.e., the band compels the player to move the racket in a proper way in order to avoid entanglement with the band. The racket 2 is thereupon accelerated during movement along the path section c in order to insure that the ball B is struck with requisite force. Contact between the ball B and the ball-engaging portion 2*a* of the racket 2 takes place at VII (see FIG. 7), whereupon the player moves the racket along the section d of the path P (follow-through). Upon completion of follow through, the racket 2 is returned to the position of FIG. 4.

FIG. 1 shows that the support 5 carries three suitably distributed bells 20. The first bell 20 is caused to produce an audible signal when the racket 2 reaches the portion V of the path P, i.e., when the player has completed the first part of the downswing. The second bell 20 furnishes a signal when the racket reaches the portion VI of the path P, i.e., if and when the player has succeeded to avoid the band 17. The third bell 20 generates an audible signal when the racket 2 reaches or approaches the position VII, i.e., during the last part of the acceleration stage of the racket provided, of course, that the racket was moved along or close to the path section c.

The use of a ball B is optional, i.e., the user can practice forehand or backhand strokes with or without a ball. Moreover, and since the bells 20 furnish readily discernible signals upon adequate or perfect completion of selected parts of each stroke, the player can practice without an instructor. The apparatus furnishes information pertaining to selected parts of each stroke, and the number of such selected parts can be chosen at will, namely, by increasing or reducing the number of bells on the support 5. With a minimum of training, the player will learn to anticipate the generation of signals during certain selected stages of each stroke and will know that the stroke was unsatisfactory if the signals are not generated at proper intervals. Consequently, the player can devote his or her attention to certain parts of each stroke, namely, to those parts which failed to effect the generation of audible signals at anticipated intervals.

As mentioned above, the same apparatus can be used for the practice of backhand strokes. The path along which the racket 2 moves while the player performs a satisfactory backhand stroke is a mirror image of the path P shown in FIG. 3.

A second mode of utilization of the improved apparatus will be preferred by advanced amateurs or by professionals. The band 17 is detached from the eyelet 16 and the carriage 8 then moves under the influence of inertia and/or gravity. The only requisite for proper operation of the apparatus 1 without the use of a band 17 is that the player should not interrupt his or her stroke. Thus, once a stroke has been started from the position shown in FIG. 4 (when the player practices forehand strokes), the player must continue to move the racket along the path P in order to insure that the bells 20 will be actuated at proper intervals (provided, of course, that the racket has been caused to move along the path P). Moveover, practicing without the band 17 compels the player to more closely follow the optimum path than in the case when the carriage 8 is attached to the band 17. The carriage 8 travels along the guide means 6 clockwise along an arc of 360 degrees. The positions of the bells 20 are somewhat different than when the carriage is connected to the band 17.

It is clear that the apparatus 1 may comprise a single bell 20, which is then mounted on the carriage 8, and several adjustable prongs 18 which are secured to the support 5 radially inwardly of the rail 7 in the path of movement of the bell. In other words, a first component of the signal producing means can be mounted on the carriage 8 and a desired number of second components of such signal producing means can be mounted on the support 5 radially inwardly of and in the path of movement of the first component.

As shown in FIG. 8, the bells 20 can be replaced by electric switches 120 (only one shown) which are adjustably secured to the support 5 by releasable coupling means 19, such as bolts and nuts. The switches 120 are located in the path of movement of and are actuated by the prong or trip 18 of the carriage (not shown) in corresponding angular positions of the carriage with respect to the support 5. Each switch 120 is electrically connected to a bell or lamp 120A by a flexible cable 120B which allows for adjustment of the switch in the circumferential direction of the support 5. The housing of the bell or lamp 120A contains a battery or another suitable source of electrical energy. The device 120A produces a visible or audible signal whenever the prong 18 actuates one of the switches 120. If desired, the device 120A can be designed to furnish visible as well as audible signals.

It is clear that the bells 20 of FIGS. 1–2 or the switches 120 of FIG. 8 can be mounted on the support in a different way. For example, the holes 21 can be replaced with a ring-shaped rail for complementary grooves of the components 20 pr 120, or with a T-groove for complementary projections of the components 20 or 120. The components 20 or 120 can be held in selected positions on the rail or in the groove by friction or by resorting to suitable securing or coupling means.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for indicating various stages of strokes which are practiced by the user of a ball-striking implement, particularly a tennis racket, having a handle and a ball-contacting portion, comprising a support which is connected to the handle; annular guide means provided on said support and spacedly surrounding the handle; and signal generating means including a carriage movably mounted on said guide means and means for producing signals in preselected positions of said carriage with respect to said guide means.

2. Apparatus as defined in claim 1, wherein said handle is elongated and said guide means is disposed in a plane which is substantially normal to the longitudinal direction of the handle.

3. Apparatus as defined in claim 1, wherein said support is a disk and said guide means is disposed at the periphery of said disk.

4. Apparatus as defined in claim 1, wherein said signal producing means comprises a first component provided on said carriage and a plurality of second components mounted on said support radially inwardly of said guide means in the path of movement of said first component.

5. Apparatus as defined in claim 1, wherein said support is a round disk having a diameter of between 5 and 40 centimeters.

6. Apparatus as defined in claim 5, wherein the diameter of said disk is approximately 15 centimeters.

7. Apparatus as defined in claim 1, wherein said support has an opening which is large enough to permit insertion or withdrawal of said handle.

8. Apparatus as defined in claim 7, further comprising means for releasably fastening said support to said handle while the handle extends through said opening.

9. Apparatus as defined in claim 1, wherein said guide means comprises a circumferentially complete rail.

10. Apparatus as defined in claim 9, wherein said carriage comprises follower means tracking said rail and said rail has at least three tracks for said follower means.

11. Apparatus as defined in claim 10, wherein said follower means includes rotary elements.

12. Apparatus as defined in claim 9, wherein said rail includes two spaced-apart roof-shaped portions and said carriage comprises at least one roller follower for each of said roof-sahped portions, each of said followers having a profile which is complementary to and contacts the respective roof-shaped portion.

13. Apparatus as defined in claim 1, further comprising an elongated flexible elastic element having a first end portion connectable to a stationary part and a second end portion, said carriage having anchoring means for said second end portion.

14. Apparatus as defined in claim 13, wherein said anchoring means includes an eyelet.

15. Apparatus as defined in claim 1, wherein said signal producing means includes a first component provided on said carriage and a plurality of second components disposed radially inwardly of said guide means and located in the path of movement of said first component, and further comprising means for adjustably coupling said second components to said support.

16. Apparatus as defined in claim 15, wherein said support includes a disk having a plurality of holes and said coupling means including fasteners extending through selected holes of said disk and arranged to separably connect said second components to said disk.

17. Apparatus as defined in claim 1, wherein said signal producing means includes a plurality of devices for generation of audible signals.

18. Apparatus as defined in claim 1, wherein said signal producing means includes electric switches secured to said support and a trip provided on said carriage and arranged to actuate said switches in a predetermined sequence during relative movement between said guide means and said carriage.

19. Apparatus as defined in claim 18, further comprising means for transmitting visible signals in response to actuation of said switches.

20. Apparatus as defined in claim 18, further comprising means for transmitting audible signals in response to actuation of said switches.

* * * * *